US011268533B2

(12) United States Patent
Loderer et al.

(10) Patent No.: US 11,268,533 B2
(45) Date of Patent: Mar. 8, 2022

(54) ROTARY PARTS FOR A SLURRY PUMP

(71) Applicants: Weir Minerals Australia Ltd, Artarmon (AU); Weir Minerals Europe Limited, Todmorden (GB)

(72) Inventors: Pavol Loderer, Todmorden (GB); Craig Ian Walker, Warriewood (AU)

(73) Assignees: Weir Minerals Europe Limited; Weir Minerals Australia Ltd.

( * ) Notice: Subject to any disclaimer, the term of this patent is extended or adjusted under 35 U.S.C. 154(b) by 0 days.

(21) Appl. No.: 15/755,476

(22) PCT Filed: Aug. 26, 2016

(86) PCT No.: PCT/AU2016/050798
§ 371 (c)(1),
(2) Date: Feb. 26, 2018

(87) PCT Pub. No.: WO2017/031550
PCT Pub. Date: Mar. 2, 2017

(65) Prior Publication Data

US 2018/0172017 A1 Jun. 21, 2018

(30) Foreign Application Priority Data

Aug. 26, 2015 (AU) ..... 2015903450

(51) Int. Cl.
*F04D 29/22* (2006.01)
*F04D 7/04* (2006.01)

(52) U.S. Cl.
CPC ..... *F04D 29/2266* (2013.01); *F04D 7/045* (2013.01); *F04D 29/2288* (2013.01)

(58) Field of Classification Search
CPC .. F04D 29/2266; F04D 29/2288; F04D 29/66; F04D 7/02; F04D 7/04; F04D 7/045; F04D 1/00; F04D 1/04
(Continued)

(56) References Cited

U.S. PATENT DOCUMENTS 1,645,498 A * 10/1927 Durdin, Jr. ..... F04D 29/225 416/186 R
1,879,803 A 9/1932 Johnson
(Continued)

FOREIGN PATENT DOCUMENTS

AU 2009253737 B2 12/2009
EA 201071360 A 6/2011
(Continued)

OTHER PUBLICATIONS

Written Opinion of the International Preliminary Examining Authority for PCT/AU2016/050798 dated Nov. 25, 2016, 6 pages.
(Continued)

*Primary Examiner* — Christopher Verdier
*Assistant Examiner* — Elton K Wong
(74) *Attorney, Agent, or Firm* — Morriss O'Bryant; Compagni Cannon, PLLC.

(57) ABSTRACT

A rotary part for a pump and related systems and methods are provided. The rotary part can be rotated in a forward direction about a rotation axis X-X and may include shroud(s) and expelling vane(s). The expelling vane(s) may have a leading side facing in the forward direction characterised in that the leading side includes a forwardly inclined section which is inclined forwardly.

8 Claims, 10 Drawing Sheets

(58) Field of Classification Search
USPC ..... 415/104, 106, 171.1
See application file for complete search history.

(56) References Cited

U.S. PATENT DOCUMENTS

| | | | | |
|---|---|---|---|---|
| 2,207,317 | A * | 7/1940 | Gear | F04D 7/04 415/97 |
| 3,384,026 | A | 5/1968 | Williamson | |
| 4,854,820 | A * | 8/1989 | Zolotar | F04D 29/445 415/171.1 |
| 5,167,678 | A * | 12/1992 | Elonen | F04D 9/003 415/169.1 |
| 5,984,629 | A | 11/1999 | Brodersen et al. | |
| 6,036,434 | A * | 3/2000 | Ray | B01F 3/04617 261/34.1 |
| 2004/0136825 | A1 | 7/2004 | Addie et al. | |
| 2015/0211523 | A1 * | 7/2015 | Bernreuther | F04D 1/04 416/3 |

FOREIGN PATENT DOCUMENTS

| | | | |
|---|---|---|---|
| GB | 535747 | A | 4/1941 |
| GB | 896366 | A | 5/1962 |
| GB | 1 255 948 | | 12/1971 |
| RU | 196253 | C1 | 1/2003 |
| RU | 2360149 | C2 | 12/2008 |
| WO | WO-2006/097908 | A1 | 9/2006 |
| WO | WO-2012/012622 | A2 | 1/2012 |
| WO | WO-2013/154461 | A1 | 10/2013 |

OTHER PUBLICATIONS

Written Opinion of the International Preliminary Examining Authority for PCT/AU2016/050798 dated Jul. 24, 2017, 6 pages.
Response to Written Opinion for PCT/AU2016/050798 dated Sep. 20, 2017, 9 pages.
International Preliminary Report on Patentability dated Oct. 23, 2017 for PCT/AU2016/050798, 13 pages.
PCT Chapter II Demand and Response to Written Opinion of the ISA dated May 16, 2017, 10 pages.
European Search Report for EP16838135.8 dated Mar. 21, 2019, 7 pages.

* cited by examiner

ROTARY PARTS FOR A SLURRY PUMP

CROSS-REFERENCE TO RELATED APPLICATIONS

This application is filed under 35 U.S.C. 371, which claims priority to and the benefit of PCT/AU2016/050798, having a filing date of Aug. 26, 2016, which claims priority to and benefit of Australian Patent Application No. 2015903450, having a filing date of Aug. 26, 2015, both of which are hereby incorporated herein by reference in their entirety for all purposes.

TECHNICAL FIELD

This disclosure relates generally to rotary parts for centrifugal slurry pumps. The rotary parts may for example be in the form of impellers, or in the form of expellers which are used in hydrodynamic seals. Slurries are usually a mixture of liquid and particulate solids, and are commonly found in minerals processing, sand and gravel and/or dredging industry.

BACKGROUND ART

Centrifugal slurry pumps of one type generally include an outer pump casing which encases a liner which has a pumping chamber therein which may be of a volute, semi volute or concentric configuration. An impeller is mounted for rotation within the pumping chamber. A drive shaft is operatively connected to the pump impeller for causing rotation thereof, the drive shaft entering the pump casing from one side. The pump further includes a pump inlet which is typically coaxial with respect to the drive shaft and located on the opposite side of the pump casing to the drive shaft. There is also a discharge outlet typically located at a periphery of the pump casing. The liner includes a main liner (sometimes referred to as the volute) and front and back side liners which are encased within the outer pump casing.

The impeller typically includes a hub to which the drive shaft is operatively connected, and at least one shroud. Pumping vanes are provided on one side of the shroud with discharge passageways between adjacent pumping vanes. The impeller may be of the closed type where two shrouds are provided with the pumping vanes being disposed therebetween. The shrouds are often referred to as the front shroud adjacent the pump inlet and the back shroud. In some applications the impeller may be of the "open" face type which comprises one shroud only.

One of the major wear areas in the slurry pump is the front and back side-liners. Slurry enters the impeller in the centre or eye, and is then flung out to the periphery of the impeller and into the pump casing. Because there is a pressure difference between the casing and the eye, there is a tendency for the slurry to try and migrate into a gap which is between the side-liners and the impeller, resulting in high wear on the side-liners.

In order to reduce the driving pressure on the slurry in the gap, as well as create a centrifugal field to expel particles, it is common for slurry pumps to have auxiliary or expelling vanes on the front shroud of the impeller. Auxiliary or expelling vanes may also be provided on the back shroud. The expelling vanes rotate the slurry in the gap creating a centrifugal field and thus reducing the driving pressure for the returning flow, reducing the flow velocity and thus the wear on the side-liner. The purpose of these auxiliary vanes is to reduce flow re-circulation through the gap. These auxiliary vanes also reduce the influx of relatively large solid particles in this gap. The outer section of these auxiliary vanes gives rise to a fluid flow system with strong vortices, which is responsible for erosion occurring on the vanes themselves and on the lining surface directly in front of the vanes. Current auxiliary vanes are usually of a quadrangular cross section. The corners of this quadrangular shape give origin to sudden changes in flow direction which can result in the formation of vortices.

A major issue for slurry pumps is the wear of the side-liner. In many applications the side-liner is the weakest point in the pump, wearing out before any other part. Much of the wear on the side-liner is a result of the flow generated by the rotating auxiliary vanes. In particular, there is wear from the tip or outer edge of the auxiliary vanes due to the creation of fluid vortices and entrained particles.

Another example of a pump rotary part is an expeller (also sometimes referred to as repellers). Expellers are used in hydrodynamic centrifugal seal assemblies. Expellers typically comprise an inner section which is mounted for rotation with the drive shaft and an outer section or shroud which is disc-like in structure. The expeller is disposed within a seal chamber which is in communication with the pump chamber via a passageway.

The expeller includes a plurality of expelling vanes which extend from the inner section and terminate at the outer peripheral edge of the outer section. The vanes are spaced apart from one another in the circumferential direction.

The centrifugal seal assembly is usually used in conjunction with a main seal apparatus which may be in the form of packings or lip seals or other types of seals.

Shaft seal assemblies of this general type for centrifugal pumps are known. The rotating expeller generates a dynamic pressure at its periphery. During rotation liquid within the seal chamber is forced to rotate with the device. This pressure helps to counter balance the pressure generated from the pump impeller. The reduced pressure at the drive shaft permits the main seal apparatus to function as low pressure seal and thereby improve the seal life. The purpose of the main shaft seal is to prevent fluid leakage when the pump has stopped.

Properly applied centrifugal seal assemblies can generate sufficient pressure to totally counter balance the pump pressure. In this situation the pumped fluid will remain clear of the pump shaft and the main shaft seal apparatus can run "dry" under these ideal conditions. To provide cooling and lubrication it may be necessary to use some type of lubrication which may be in the form of grease or water from an external source.

In operation, the rotating expeller generates a rotating fluid field in the seal chamber. When it is in the form of a slurry, the rotating fluid can give rise to wear on various components of the seal.

SUMMARY OF THE DISCLOSURE

In a first aspect, embodiments are disclosed of a rotary part for a pump which can be rotated in a forward direction about a rotation axis X-X; the rotary part comprising a shroud having an outer peripheral edge portion and opposed first and second faces, a plurality of expelling vanes projecting from one or more of the second faces of the shroud, each expelling vane having an inner side and an outer side which is at or near the outer peripheral edge portion of the shroud, the expelling vanes extending in a direction between the rotation axis X-X towards the outer peripheral edge portion of the shroud, each expelling vane further having a leading side facing in the forward direction and having an inner edge and an outer edge, a trailing side facing in a rearward direction and an upper side spaced from the outer face of the shroud, wherein the leading side includes a forwardly inclined section which is inclined forwardly from a radial line Y-Y extending from the rotation axis X-X and which passes through the inner edge of the leading side.

In certain embodiments, the forwardly inclined section has a profile which is generally linear.

In certain embodiments, the forwardly inclined section has an inner end and an outer end and extends from the inner edge towards the shroud outer peripheral edge portion.

In certain embodiments, the forwardly inclined section extends from the inner edge and terminates at the outer edge of the leading side.

In certain embodiments, the forwardly inclined section extends from the inner edge and terminates at the outer end which is at an intermediate region which is in spaced relation from the outer peripheral edge portion of the shroud. The leading side further including a trailing section which extends rearwardly from the outer end at the intermediate region of the forwardly inclined section. The trailing section terminating at the outer peripheral edge portion. In certain embodiments the trailing section includes a curved section which curves rearwardly from the outer end. In certain embodiments the leading side of the trailing section is curved. In certain embodiments the outer edge of the trailing section terminates at the outer peripheral edge portion of the shroud but in other embodiments the outer edge may be spaced from the outer peripheral edge portion.

In certain embodiments the leading side of the trailing section is linear and extends from the outer end to the outer peripheral edge portion.

In certain embodiments there is further provided a plurality of spaced apart projections on the trailing section and extending rearwardly of the trailing side.

In certain embodiments the outer end is closer to the outer peripheral edge portion than to the central axis.

In certain embodiments, the forward inclined section is inclined at an angle of up to 30° from the radial line Y-Y.

In certain embodiments, the inclined angle is from 4° to 15°.

In certain embodiments, the rotary part comprises an impeller. In this particular embodiment the inclined angle is from 4° to 8° and in certain embodiments about 4°.

In certain embodiments, the impeller which comprises two shrouds, one being a front shroud, the other being a back shroud, the pumping vanes extending between the shrouds, each shroud having an inner face and an outer face, the expelling vanes being on the outer face of the front and/or back shroud.

In certain embodiments, the rotary part is an expeller for use in a hydrodynamic seal. In certain embodiments the inclined angle is from 4° to 8° and in certain embodiments about 4°.

In certain embodiments, the upper side has a main surface, the distance between the shroud face and the main surface being 0.1 to 0.3 D, where D is the diameter of the shroud.

In certain embodiments, the forwardly inclined section extends from the inner edge to the intermediate region a distance from 0.65 to 0.95 D, where D is the diameter of the shroud.

In certain embodiments, the pumping vanes are backwardly sloped.

Other aspects, features, and advantages will become apparent from the following detailed description when taken in conjunction with the accompanying drawings, which are a part of this disclosure and which illustrate, by way of example, principles of inventions disclosed.

BRIEF DESCRIPTION OF THE DRAWINGS

Notwithstanding any other forms which may fall within the scope of the method and apparatus as set forth in the Summary, specific embodiments of the method and apparatus will now be described, by way of example, and with reference to the accompanying drawings in which.

DETAILED DESCRIPTION OF SPECIFIC EMBODIMENTS

Figure 1:
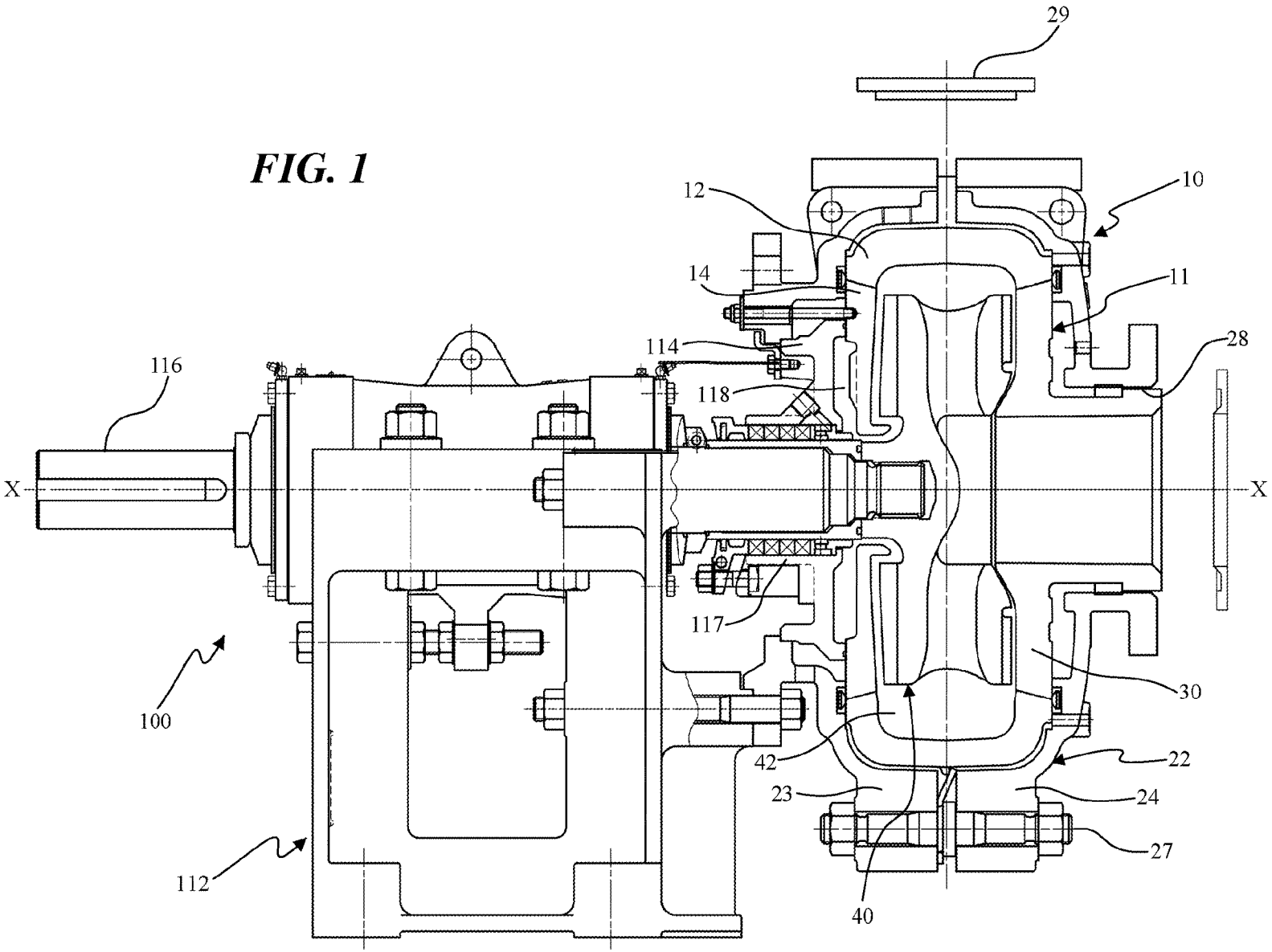
FIG. 1 is a schematic partial cross-sectional side elevation of one form of a pump apparatus.

Referring in particular to FIG. 1 of the drawings, there is generally illustrated pump apparatus 100 comprising a pump 10 and pump housing support in the form of a pedestal or base 112 to which the pump 10 is mounted. Pedestals are also referred to in the pump industry as frames. The pump 10 generally comprises an outer casing 22 that is formed from two side casing parts or sections 23, 24 (sometimes also known as the frame plate and the cover plate) which are joined together about the periphery of the two side casing sections 23, 24. The pump 10 is formed with side openings one of which is an inlet hole 28 there further being a discharge outlet hole 29 and, when in use in a process plant, the pump is connected by piping to the inlet hole 28 and to the outlet hole 29, for example to facilitate pumping of a mineral slurry.

The pump 10 further comprises a pump inner liner 11 arranged within the outer casing 22 and which includes a main liner 12 and two side liners 14, 30. The side liner (or back liner) 14 is located nearer the rear end of the pump 10 (that is, nearest to the pedestal or base 112), and the other side liner (or front liner) 30 is located nearer the front end of the pump. The side liner 14 is sometimes referred to as the frame plate inner insert and the side liner 30 is sometimes referred to as the throatbrush. The main liner comprises two side openings therein.

As shown in FIG. 1 the two side casing parts 23, 24 of the outer casing 22 are joined together by bolts 27 located about the periphery of the casing parts 23, 24 when the pump is assembled for use. In some embodiments the main liner 12 can also be comprised of two separate parts which are assembled within each of the side casing parts 23, 24 and brought together to form a single main liner, although in the example shown in FIG. 1 the main liner 12 is made in one-piece, shaped similar to a car tyre. The liner 11 may be made of materials such as rubber, elastomer or of metal.

When the pump is assembled, the side openings in the main liner 12 are filled by or receive the two side liners 14, 30 to form a continuously-lined pumping chamber 42 disposed within the pump outer casing 22. A seal chamber housing 114 encloses the side liner (or back liner) 14 and is arranged to seal the space or chamber 118 between drive shaft 116 and the pedestal or base 112 to prevent leakage from the back area of the outer casing 22. The seal chamber housing takes the form of a circular disc section and an annular section with a central bore, and is known in one arrangement as a stuffing box 117. The stuffing box 117 is arranged adjacent to the side liner 14 and extends between the pedestal 112 and a shaft sleeve and packing that surrounds the shaft 116.

Figure 2:
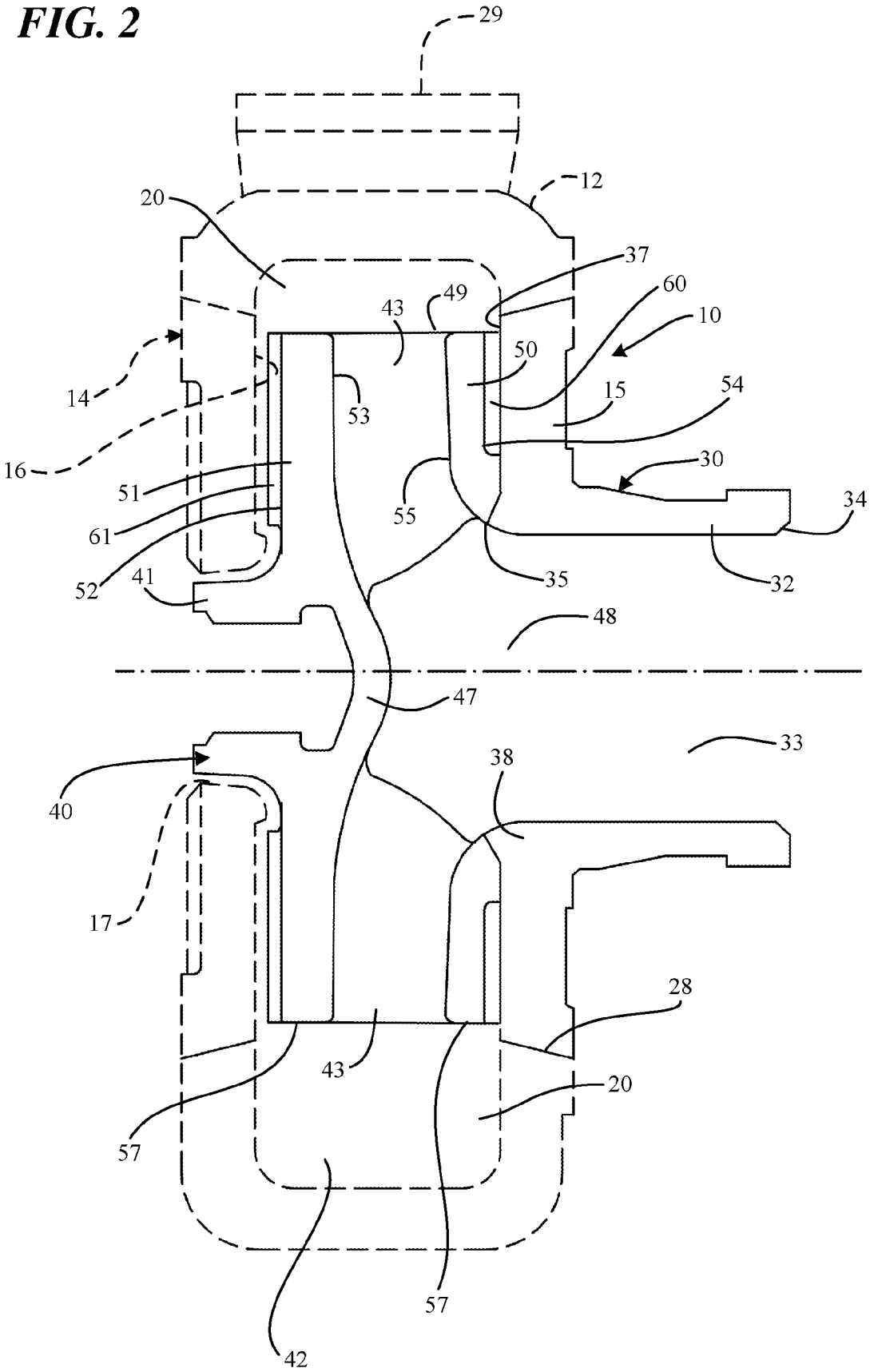
FIG. 2 is a more detailed schematic partial cross-sectional side elevation of a pump apparatus similar to that shown in FIG. 1.

As shown in FIGS. 1 and 2 an impeller 40 is positioned within the main liner 12 and is mounted or operatively connected to the drive shaft 116 which is adapted to rotate about a rotation axis X-X. A motor drive (not shown) is normally attached by pulleys to an exposed end of the shaft 116, in the region behind the pedestal or base 112. The rotation of the impeller 40 causes the fluid (or solid-liquid mixture) being pumped to pass from a pipe which is connected to the inlet hole through the pumping chamber 42 which is within the main liner 12 and the side liners 14, 30 and then out of the pump via the discharge outlet hole.

As shown in particular in FIG. 2, the front liner 30 (or throatbrush) includes a cylindrically-shaped delivery section 32 through which slurry enters the pumping chamber 42 when the pump is in use. The delivery section 32 has a passage 33 therein with a first, outermost end 34 operatively connectable to a feed pipe (not shown) and a second, innermost end 35 adjacent the chamber 42. The front liner 30 further includes a side wall section 15 which mates in use with main liner 12 to form and enclose the chamber 42, the side wall section 15 having an inner face 37. The second end 35 of the front liner 30 has a raised lip 38 thereat, which is arranged in a close facing relationship with the impeller 40 when in an assembled position. The back liner 14 comprises a disc-like body having an outer edge which mates with the main liner and an inner face 16.

The impeller 40 includes a hub 41 from which a plurality of circumferentially spaced pumping vanes 43 extend. An eye portion 47 extends forwardly from the hub 41 towards the passage 33 in the front liner 30. The impeller 40 further includes a front shroud 50 and a back shroud 51, the vanes 43 being disposed and extending therebetween and an impeller inlet 48. The hub 41 extends through a hole 17 in back liner 14.

The front shroud 50 includes an inner face 55, an outer face 54 and a peripheral edge portion 56. The back shroud 51 includes an inner face 53, an outer face 52 and a peripheral edge portion 57. The front shroud 50 includes an inlet 48, being the impeller inlet and the vanes 42 extend between the inner faces of the shrouds 50, 51. The shrouds are generally circular or disc-shaped when viewed in elevation; that is in the direction of rotation axis X-X.

As illustrated in FIG. 2, each shroud has a plurality of auxiliary or expelling vanes on the outer faces 52, 54 thereof, there being a first group of auxiliary vanes 60 on the outer face 54 of the front shroud 50 and a second group of auxiliary vanes 61 on the outer face 52 of the back shroud 51.

Figure 3:
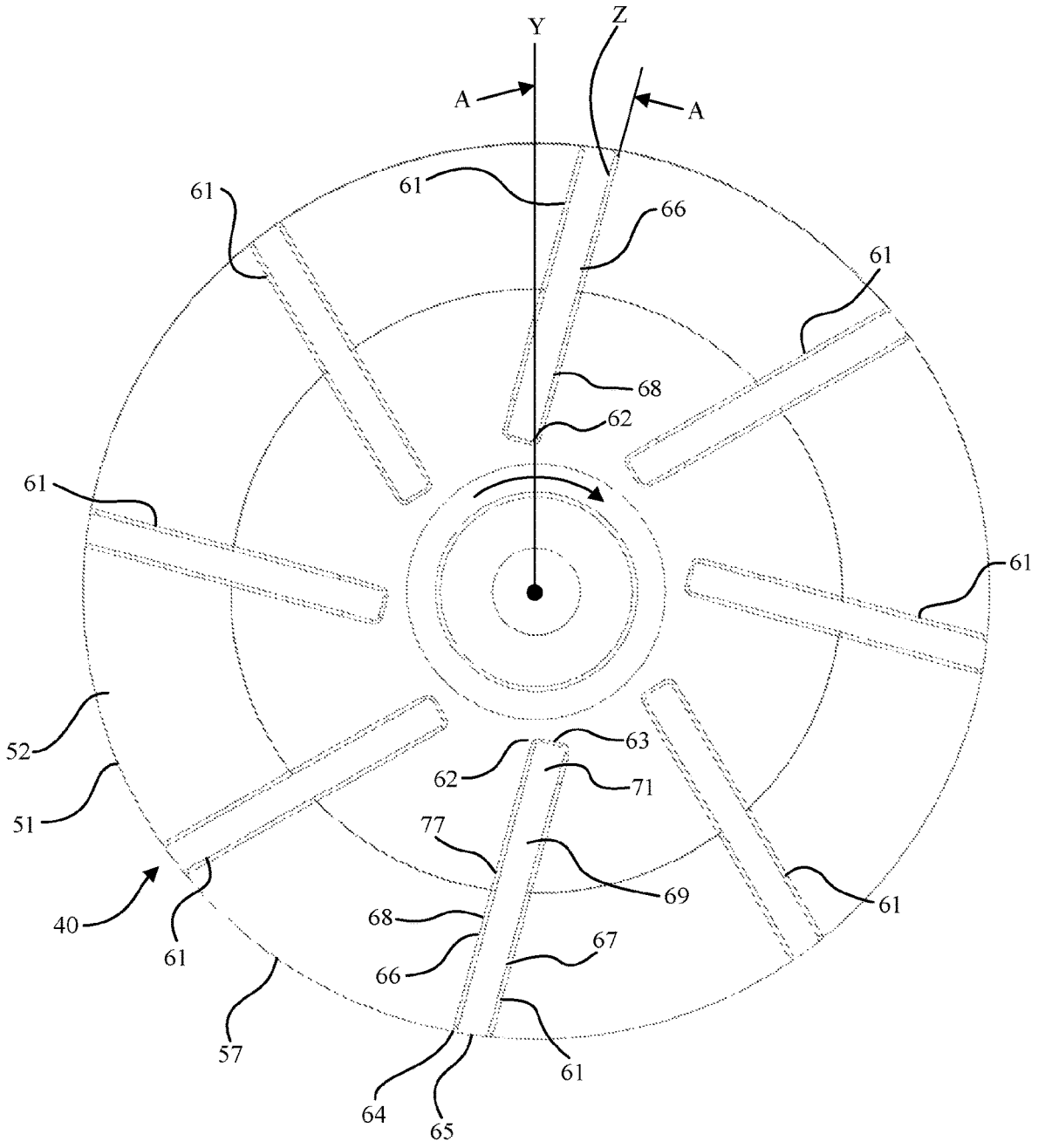
FIG. 3 is a rear elevational view of a pump impeller, according to one embodiment of the present disclosure with an arrow showing the direction of rotation.
Figures 4, 5:
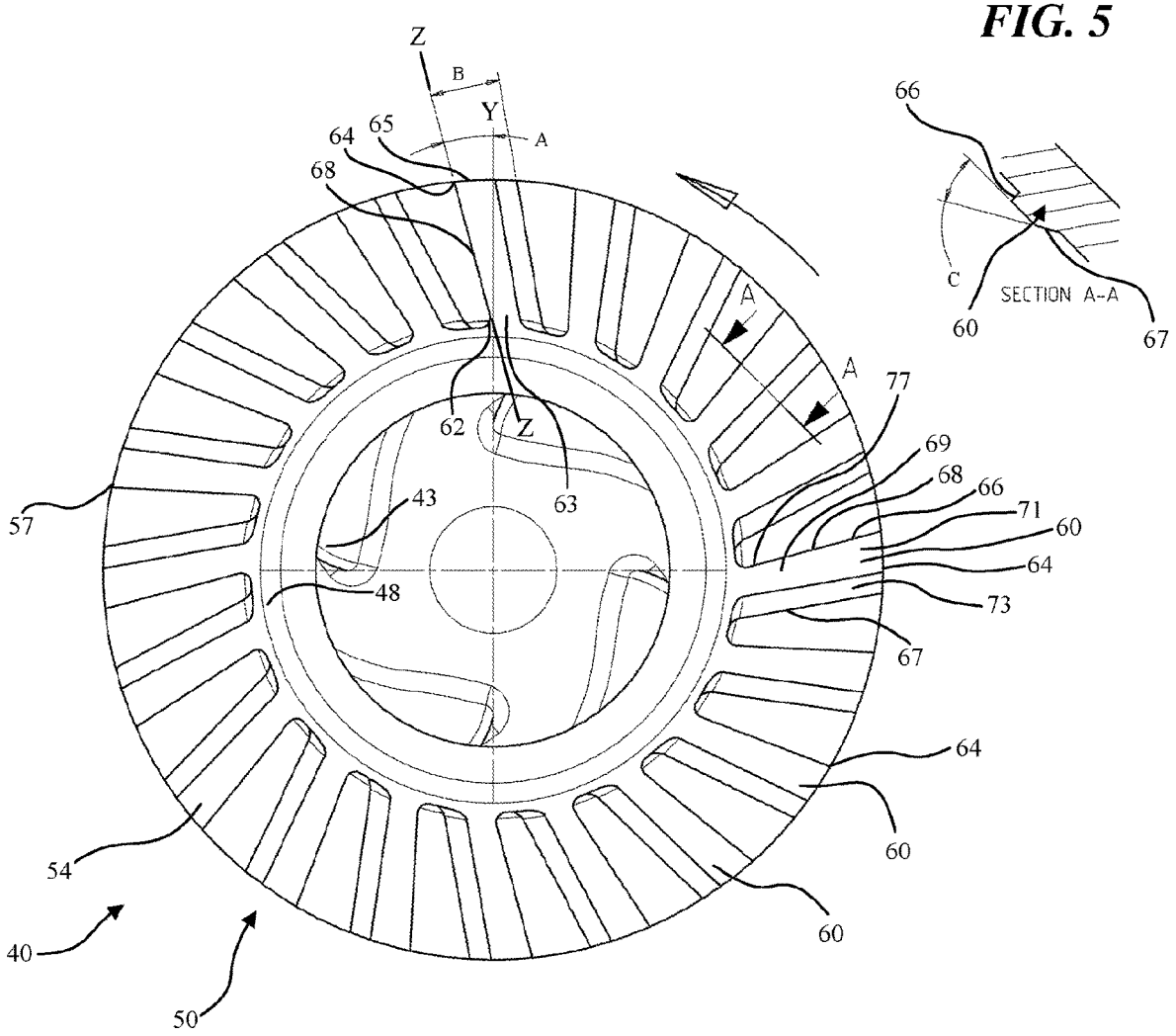
FIG. 4 is a front elevational view of a pump impeller according to another embodiment of the present disclosure with an arrow showing the direction of rotation.
FIG. 5 is a sectional view taken along the line A-A in FIG. 4.

FIGS. 3 and 4 illustrate two embodiments of impeller 40. In FIG. 3 auxiliary or expelling vanes 61 are shown on the back shroud 51 and in FIG. 4 auxiliary or expelling vanes 60 are shown on the front shroud. In the following description the same reference numerals are used to identify the same features of the vanes 60 and 61. The auxiliary or expelling vanes 60 on the front shroud and vanes 61 on the back shroud comprise a leading side 66, and a trailing side 67 with respect to the direction of rotation as well as an upper side 69, an inner side 63 and an outer side 65. The upper side 69 has a main surface 71. The main surface 71 is generally flat or planar and is generally in a plane parallel with the shroud outer surface 52, 54. FIG. 3 illustrates the expelling vanes 61 on the back (or rear) shroud of the impeller 40, and FIG. 3 illustrates the expelling vanes 60 on the front shroud 50. As shown in FIGS. 4 and 5, the trailing side 67 may have an inclined surface or wall 73 which is inclined relative to both the upper surface 71 of the upper side 69, and to the outer face 54 of the front shroud 50. The leading side 66 includes an inner edge 62, an outer edge 64, and has a main surface 77 which extends generally at right angles to the upper surface 71 and to the outer face 52, 54. The outer edge 64 is at the outer peripheral edge portion 57 of the back shroud 51, and follows its arcuate contour. In other embodiments, the outer edge of the expelling vanes may not extend completely to the outer edge of the shroud. The leading and trailing sides 66, 67 of the auxiliary vanes 60 are generally parallel to one another in the embodiments shown in FIG. 3 but in the embodiment of FIG. 4 they are inclined with respect to one another.

The leading side 66 comprises a forwardly inclined section 68 which extends from the inner edge 62 of the expelling vanes 60 and 61. The forwardly inclined section 68 has a generally linear profile. In the embodiments of FIGS. 2 and 3, the forwardly inclined section 68 extends from the inner edge 62 to the outer edge 64 which is located at the shroud peripheral edge portion 57. In the embodiment of FIG. 2, the expelling vanes 61 are on the outer face 54 of the back shroud 51. In the embodiment of FIG. 4, the expelling vanes are on the outer face 54 of the front shroud 50. In other embodiments the outer edge 64 is spaced from the shroud peripheral edge portion 57.

Figure 6:
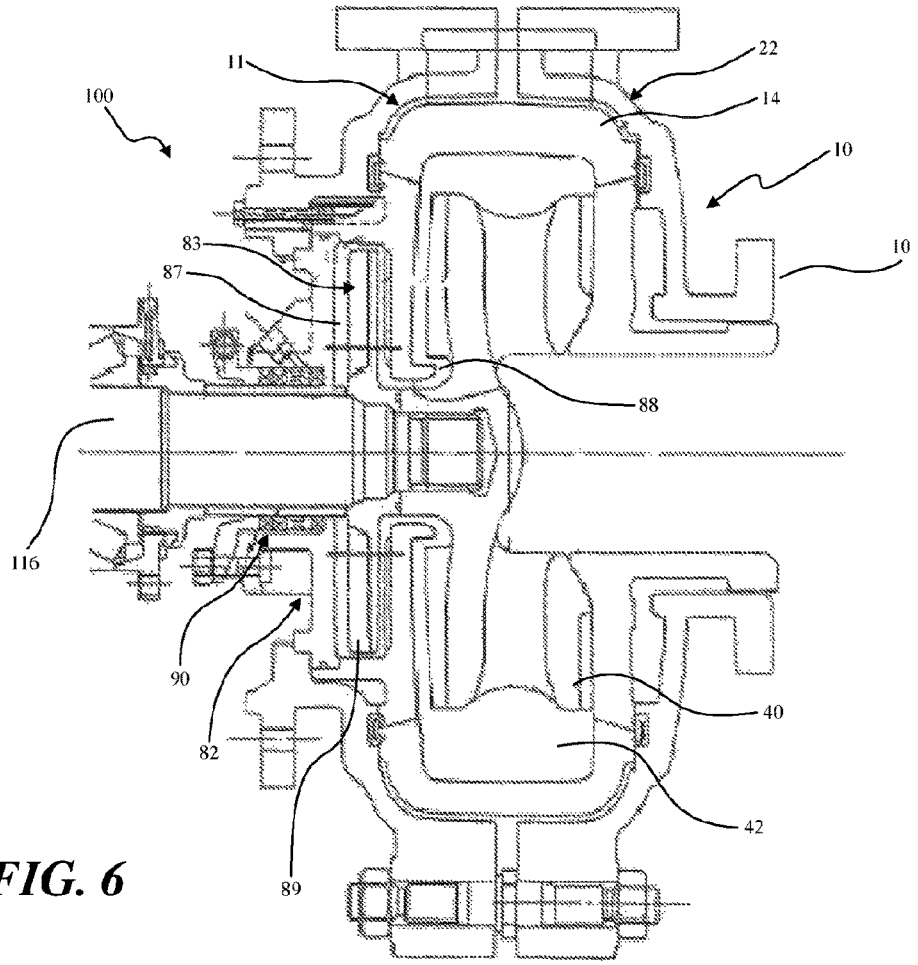
FIG. 6 is a schematic partial cross-section of a pump with a typical centrifugal or hydrodynamic seal assembly.

Another form of pumping apparatus is partially illustrated in FIG. 6. Referring to FIG. 6 of the drawings, there is shown pump apparatus 100 including a pump 10, the pump comprising a pump casing 22 and a liner 11 with a pumping chamber 42 therein. The pump 10 further includes a pump impeller 40, the impeller being mounted for rotation on a drive shaft 116 and disposed within pumping chamber 42.

Figure 7:
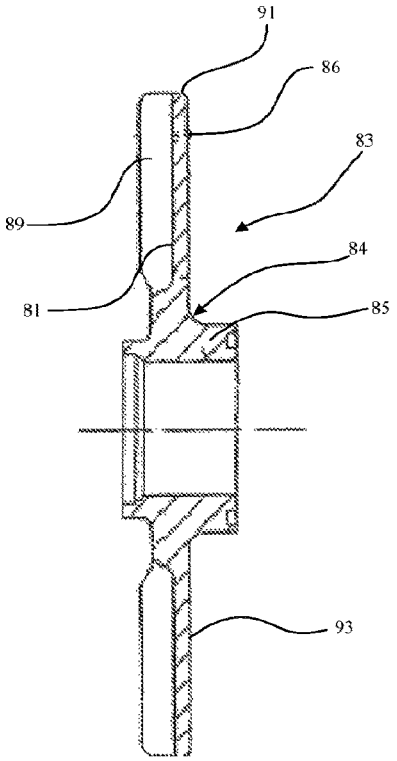
FIG. 7 is a sectional side elevation of an expeller for the hydrodynamic seal assembly of FIG. 5.

To one side of the pump casing 22 is a centrifugal seal assembly 82 which includes a rotatable seal device or expeller 83. This is illustrated in FIG. 7. The seal device or expeller 83 comprises a generally circular (or disc-shaped) main body 84 having a main surface 81 and opposed surface 93, an inner section 85 which is mounted to the drive shaft 116 and an outer section or shroud 86 which in the form shown is disc-like in structure with an outer peripheral edge portion 91. The expeller 83 is mounted to the drive shaft 116 for rotation therewith. The expeller 83 is disposed within a seal chamber 87 (FIG. 6) which is in fluid communication with the pumping chamber 42 via passageway 88.

The expeller 83 includes a plurality of expelling vanes 89 on surface 81 of the main body 84 and which extend from the inner section 85 of the main body 84 and terminate at the outer peripheral edge 91 of the outer section or shroud 86. The expelling vanes 89 are spaced apart from one another in the circumferential direction. The expelling vanes are clearly illustrated in FIG. 8.

The centrifugal seal assembly 82 is used in conjunction with a main seal apparatus 90 which may be in the form of packings, as shown, or lip seals or other types of seals.

Figure 8:
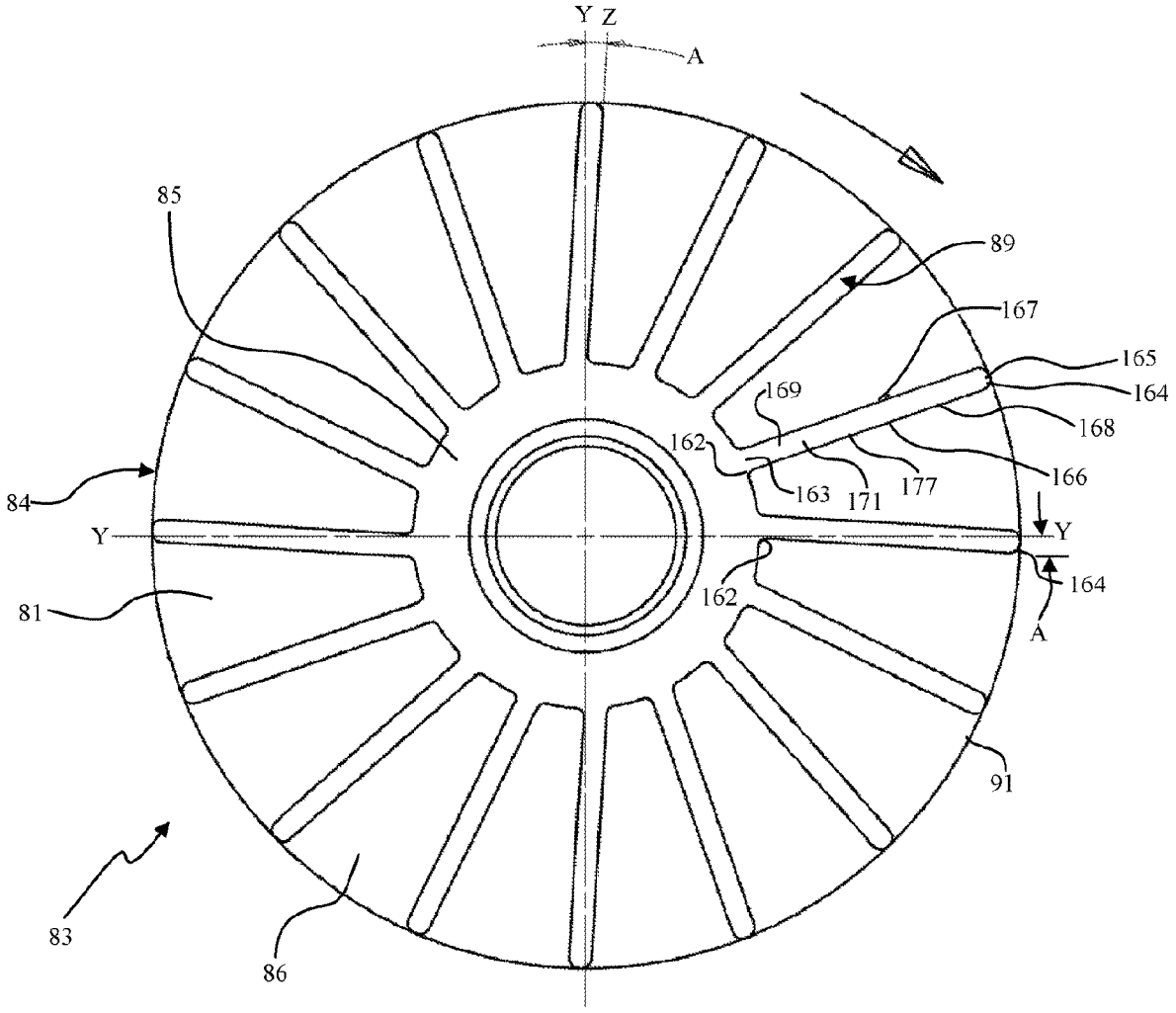
FIG. 8 is a front elevation of an expeller according to a further embodiment.

One form of the expelling vanes is illustrated in FIG. 8 and described below.

With reference in particular to FIG. 8 the expelling vanes 89 of expeller 83 are described. The vanes 89 comprise a leading side 166, and a trailing side 167 with respect to the direction of rotation, as well as an upper side 169, an inner side 163 and an outer side 165. The upper side 169 has a main surface 171. The main surface 171 is generally flat or planar and is generally in a plane parallel with surface 81 of the main body 84. The leading side 166 includes an inner edge 162, an outer edge 164, and has a main surface 177 which extends generally at right anglers to the upper surface 171 and to the surface 81. The outer edge 164 is at an outer peripheral edge portion 91 of the main body 84. In other embodiments, the outer edge of the expelling vanes may not extend completely to the outer edge portion 91. The leading and trailing sides 166, 167 of the auxiliary vanes 89 are generally parallel to one another.

The leading side 166 comprises a forwardly inclined section 168 which extends from the inner edge 162 of the expelling vanes 89. The forwardly inclined section 168 has a generally linear profile. In the embodiment of FIG. 8, the forwardly inclined section 168 extends from the inner edge 162 to the outer edge 164 which is located at outer edge portion 91.

As shown in FIGS. 4, 5 and 8 the angle A of the forwardly inclined section 168 of the leading side with respect to a radial line Y-Y extending in the direction of line Z-Z from the rotation axis and passing through the inner edge of the leading side can vary. The angle of inclination is a balance between improved wear against sealing efficiency. In the embodiment illustrated in FIG. 3 the angle A is 15°. In the embodiments illustrated in FIG. 4 the angle A is 15°. In the embodiment illustrated in FIG. 8 the angle A is 4°. Furthermore, the inclined section of the leading side and the trailing side may be inclined at an angle B with respect to one another. As shown in FIG. 4 the angle B is 5°. In the embodiment shown in FIGS. 4 and 5 the trailing side has an inclined surface which is inclined at an angle C which in the embodiment shown is 30°. This is best seen in FIG. 5.

Figure 9:
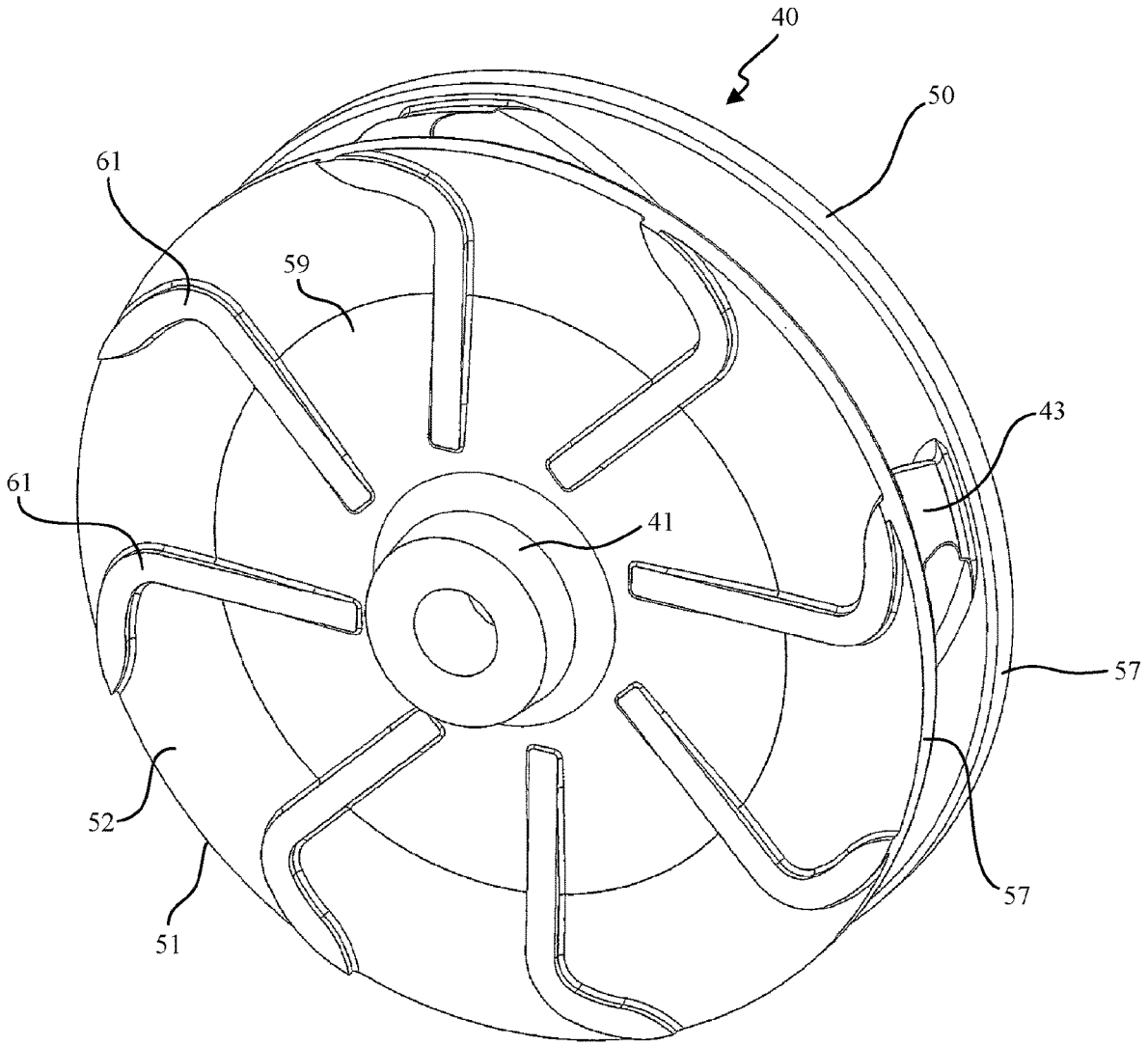
FIG. 9 is an isometric view of a pump impeller according to another embodiment of the present disclosure.
Figure 10:
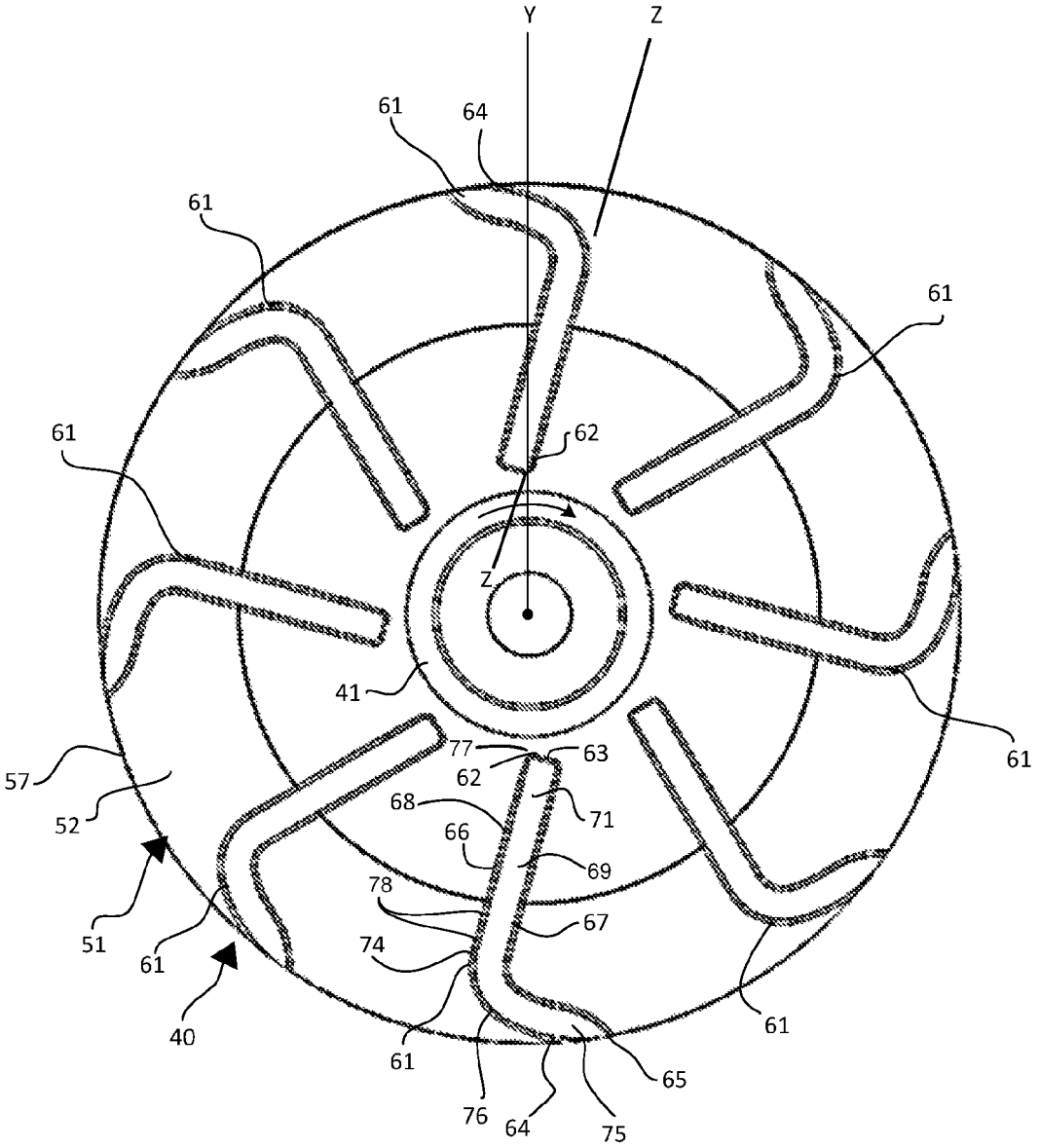
FIG. 10 is a rear elevational view of the pump impeller shown in FIG. 9.

FIGS. 9 and 10 illustrate a further embodiment of impeller in which auxiliary vanes 61 are shown on the back shroud 51 and comprise a leading side 66, and a trailing side 67 with respect to the direction of rotation, as well as an upper side 69, an inner side 63 and an outer side 65. The upper side 69 has a main surface 71. The main surface 71 is generally flat or planar and is generally in a plane parallel with the shroud outer surface 52. The leading side 66 includes an inner edge 62, an outer edge 64, and has a main surface 71 which extends generally at right angles to the upper surface 71 and to the outer face 52. The outer edge 64 is at the outer peripheral edge portion 57 of the back shroud 51, and follows its arcuate contour. In other embodiments, the outer edge of the expelling vanes may not extend completely to the outer edge of the shroud. The leading and trailing sides 66, 67 of the auxiliary vanes 61 are generally parallel to one another.

The leading side 66 comprises a forwardly inclined section 68 which extends from the inner edge 62 of the expelling vanes 61 and a trailing section 75. The forwardly inclined section 68 has a generally linear profile. The forwardly inclined section 68 has an inner end 77 which is at the inner edge 62 and an outer end 78.

In the embodiment of FIGS. 9 and 10, the forwardly inclined section 68 extends from the inner edge 62 and terminates at the outer end 78 which is remote from the inner edge 62 and which is spaced from the outer peripheral edge portion 57 of the shroud 51. In this embodiment, the trailing section 75 extends from the outer end 69 at an intermediate region 74 to the outer peripheral edge portion 57. The intermediate region 74 provides for a junction between the inclined section 68 and trailing section 75. As illustrated in FIGS. 2 to 4, the forwardly inclined section 68 is linear and extends in the direction of line Z-Z which is forwardly inclined with respect to radial line Y-Y which passes through the inner edge 62.

The trailing section includes a curved section 76 in which the leading side 66 in this section curves rearwardly from the outer end 69 at the intermediate region 74 towards the outer peripheral edge portion 57.

The vanes 61 in FIGS. 9 and 10 are shown on the rear or back shroud 51 but it will be understood that the vanes could be on the front shroud. The vanes may be on one shroud only or on both shrouds.

In the embodiment shown there are 8 vanes 61 on the back shroud 51. The forward angle of inclination of the forwardly inclined section 68 is about 15°. The vane width between the leading and trailing sides is about 0.03 D where D is the outer diameter of the impeller shroud. The vanes have a height which is the distance from the shroud face to the upper side of about 0.01 D. The radius of curvature of the curved section 76 is about 0.8 D. The intermediate region 74 is about 0.9 D.

Figure 11:
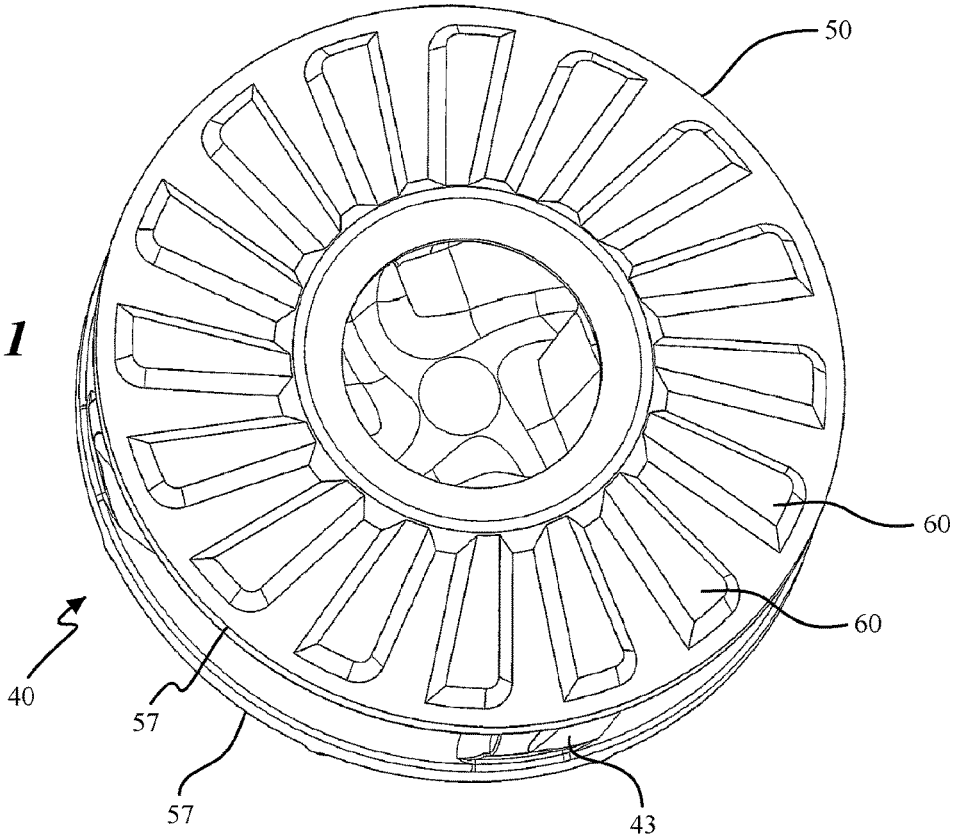
FIG. 11 is an isometric view of a pump impeller according to another embodiment of the present disclosure from one side.
Figure 12:
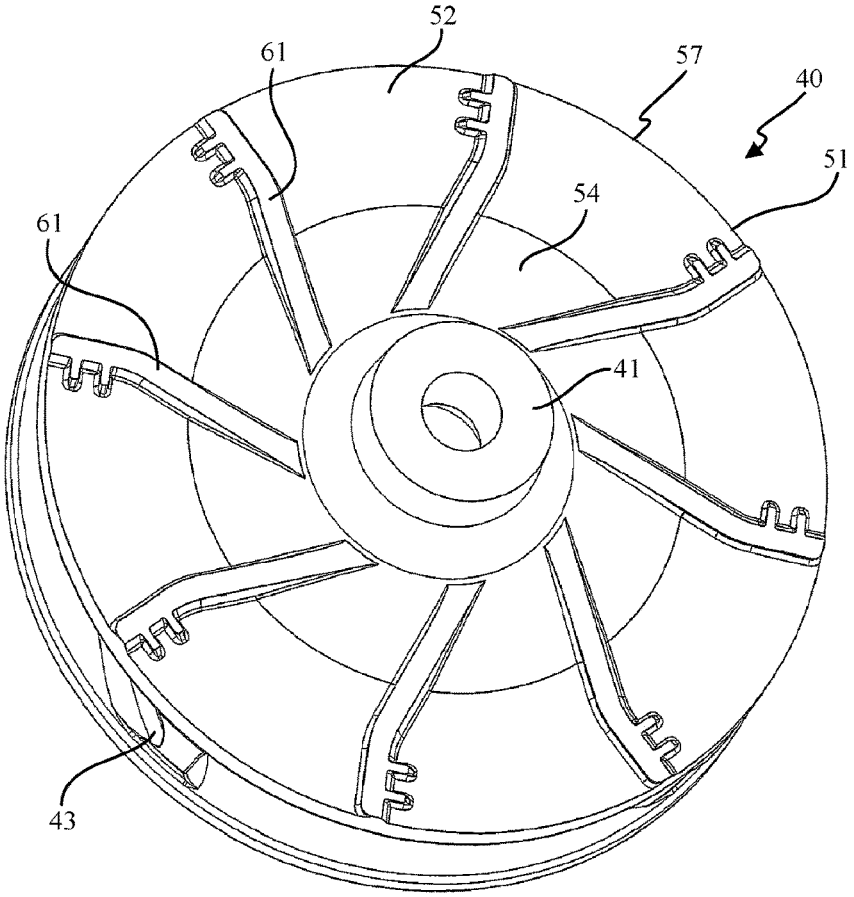
FIG. 12 is an isometric view of the pump impeller shown in FIG. 11 from the other side.

FIGS. 11 and 12 illustrate a further embodiment of impeller. In this embodiment a plurality of auxiliary vanes 61 are arranged on the back shroud 51 on the outer face 52 thereof. In this embodiment each vane comprises a leading side 66 and a trailing side 67 with respect to the direction of rotation of the impeller. Each vane further comprises an upper side 69, an inner side 63 and an outer side 65, the upper side 69 having a main surface 71. The main surface 71 is generally flat or planar and is generally in a plane parallel with the shroud outer surface 52. The leading side 66 includes an inner edge 62, an outer edge 64, and has a main surface 71 which extends generally at right angles to the upper surface 71 and to the outer face 52. The outer edge 64 is at the outer peripheral edge portion 57 of the back shroud 51. In other embodiments, the outer edge of the expelling vanes may not extend completely to the outer edge of the shroud. The leading and trailing sides 66, 67 of the auxiliary vanes 61 are generally parallel to one another.

The leading side 66 comprises a forwardly inclined section 68 which extends from the inner edge 62 of the expelling vanes 61 and a rearwardly inclined section 75 which inclines rearwardly with respect to the forwardly inclined section 68. The forwardly inclined section 68 has a generally linear profile. The forwardly inclined section 68 has an inner end 77 at the inner edge 62 and an outer end 78. In this embodiment the forwardly inclined section 68 extends from the inner edge 62 and terminates at an outer end 78 which is remote from the inner edge 62 and which is spaced from the outer peripheral edge portion 57 of the shroud 51. In this embodiment, the trailing section 75 extends from the outer end 78 at an intermediate region 74 to the outer peripheral edge portion 57. The intermediate section 74 provides for a junction between the inclined section 68 and trailing section 75. As illustrated in FIGS. 2 to 4, the forwardly inclined section 68 is linear and extends in the direction of line Z-Z which is forwardly inclined with respect to radial line Y-Y which passes through the inner edge 62.

In this embodiment the trailing section 75 has a linear leading side which extends from the outer end 69 at the junction 74 to the outer peripheral edge portion 57 of the shroud.

As shown in FIGS. 11 and 12 the auxiliary vanes 60 have associated therewith a plurality of projections 95, 96 which extend generally laterally from the trailing side 67 of the auxiliary vanes 60, the projections being spaced apart along the length thereof. The projections 95, 96 may extend at 90° to the trailing side 67 or to a radial line extending from the rotation axis X-X. Projections of this type are described in patent specification WO 2016/040999, the contents of which are incorporated into this specification by cross reference.

As shown, the projections are generally oblong in shape and include inner and outer sides, a top side and an end side. The surfaces of each of the sides are generally flat or planar. The projections have a height measured from the outer face 52 of the shroud 50 to the top side 99 of the projection, and the auxiliary vanes have a height measured from the outer face 52 of the shroud 50 to the main surface 71 of the upper side of the auxiliary vane. The projections have a length taken from the trailing side 67 of the auxiliary vane 60 with which the projection is associated to its end side 86. As shown, the length of the projection associated with the auxiliary vane is substantially the same. In the embodiment shown, the projections 95, 96 are spaced from one another and positioned at the trailing side 67 of the auxiliary vane 60 both closer to the outer edge 65 than the inner edge 63. In this embodiment the top side 94 of the projections is spaced inwardly from the main surface 71 of the upper side 69 of the auxiliary vane 60.

As can be seen the leading side in this embodiment is generally V-shaped although one arm of the V is longer than the other. Further as it is apparent from FIG. 11 of the shroud 51 has an inclined surface or frusto-conical shaped surface 59 in an inner region which surrounds the hub 41. The vanes in this region taper in height so as to blend with this surface 59. The provision of the rearwardly extending section reduces the strength of a vortex generated at the outer edge or tip of the vane. In use conventional auxiliary vanes, there is an outward radial flow in the region of the trailing side of the auxiliary vane which intersects with a tangential flow at the outer edge or vane top of the auxiliary vane. It is these intersecting flows which generate a strong tip vortex. It is this tip vortex which causes significant wear on the respective impeller when it is exposed to a particulate slurry material during operating of the impeller in a pump.

The projections provide that the radial outflow on the shroud is disturbed or deflected and is thus reduced. There is a reduction on the strength of the vortex generated at the outer edge or tip of the vane relative to conventional expelling vanes. This leads to a reduction in the outflow velocity and reduces the wear rate at the tip of the vane.

Figure 13:
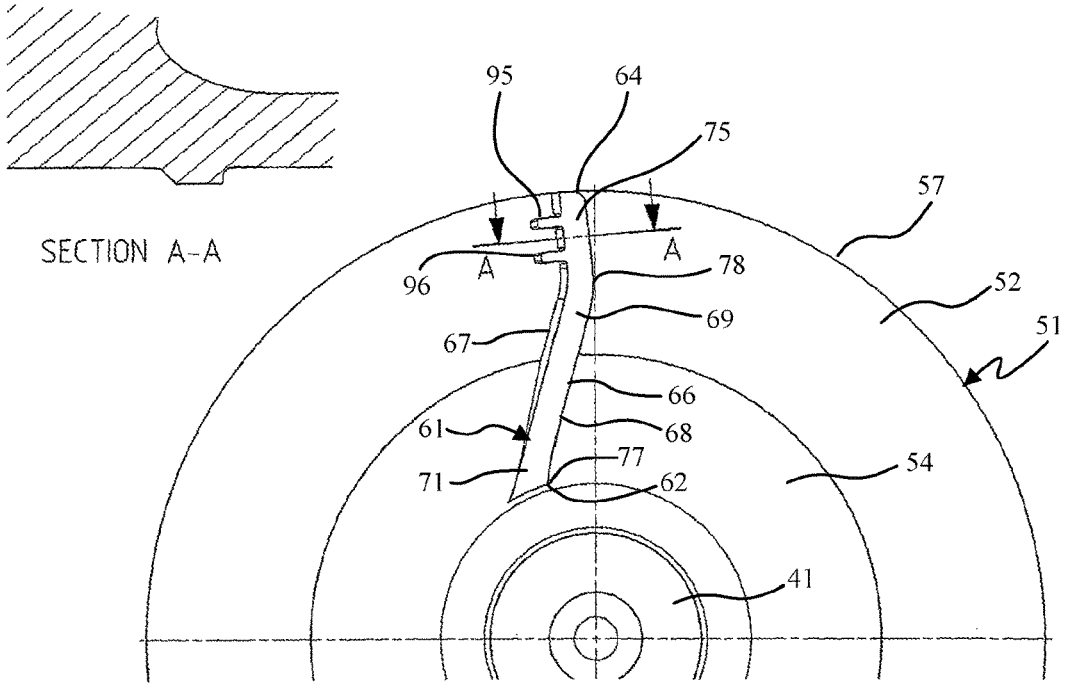
FIG. 13 is a rear elevational view of the impeller shown in FIGS. 11 and 12.
Figure 14:
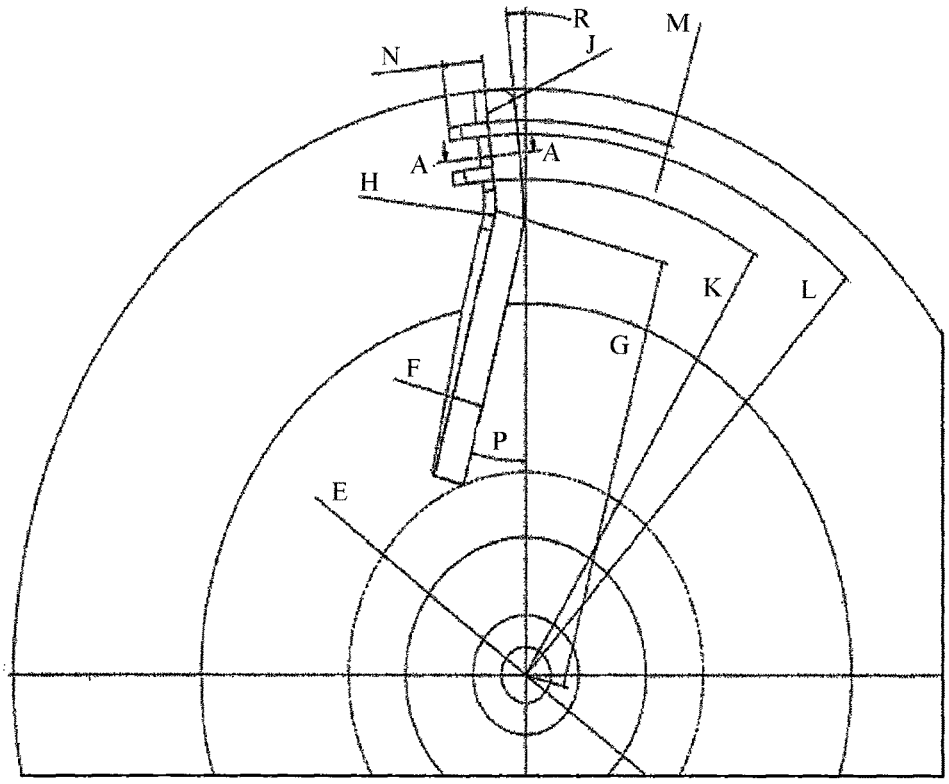
FIG. 14 is a similar view to that of FIG. 13 showing certain angles and dimensions.

FIG. 14 identifies various angles and dimensions relating to the embodiment shown in FIGS. 11 to 13. Set out below are details of these dimensions and angles and ranges for certain dimensions.

P is the angle of inclination of the forwardly inclined section.

R is the angle of inclination of the rearwardly extending section.

N is the distance from the leading side of the trailing section to the remote end of the projections.

M is the width of the projections.

F is the width of the vane.

G is the distance from the outer end to the central axis.

K is the distance from the inner side of the inner projection to the central axis.

L is the distance from the inner side of the outer projection to the central axis.

D is the diameter of the shroud.

H is the radius of curvature of the junction between the outer end of the leading side of the forwardly inclined section and the trailing section.

E is the distance from the inner edge of the leading side of the forwardly inclined section to the central axis.

J is the radius of curvature of the outer edge of the leading side of the vane.

P=15° R=6°

N=0.04 D M=0.012 D

F=0.03 D K=0.85 D/2

G=0.75 D/2 L=0.92 D/2

P may be in the range from 4° to 30°.

G may be in the range from 0.6 D/2 to 0.9 D/2.

R may be in the range from 3° to 10°.

The length of the forwardly inclined section to the length of the rearwardly inclined section may be from 1.33:1 to 3:1.

In the embodiment of impeller illustrated in FIG. 3 the auxiliary vanes of the type shown are on the back shroud of an impeller. In the embodiment of impeller illustrated in FIG. 4 the auxiliary vanes of the type shown are on the front shroud. Furthermore, in FIGS. 9 and 12 the auxiliary vanes of the type shown are on the back shroud. It is to be understood that the various types of auxiliary vanes shown could be on the back or front shroud. It is further contemplated that the auxiliary vanes could be on one of the shrouds with no auxiliary vanes or conventional auxiliary vanes being on the other shroud. Also one type of auxiliary vane as described above could be on one of the shrouds and the same or another type of auxiliary vane could be on the other shroud. With regard to the expeller described with reference to FIGS. 7 and 8 any of the types of auxiliary vanes described above may find use on the expeller.

Experiments and trials have shown that the auxiliary or expelling vanes 60, 61 and 89 illustrated in FIGS. 3, 4, 8 and 9 can generate a higher head because of the forwardly inclined section. This leads to an increase in the pressure in the gap between the front side liners and front impeller shroud which in turn reduces the pressure differential between the gap and the rest of the pumping chamber, resulting in reduced recirculation flow in the gap and therefore fewer particulates passing through the gap. This can lead to less wear on the impeller shroud and front side liner, and increase the functioning life of these components. The forwardly inclined expelling vanes on the rear shroud of the impeller have been experimentally observed to reduce the pressure in the rear seal chamber of the pump. This reduction in seal chamber pressure is due to the extra head generated by the forwardly inclined vanes in the gap between the impeller rear shroud and pump back side liner reducing the pressure differential between the gap and the main pumping chamber. The reduction in pressure in the sealing chamber effects a more reliable sealing of the pump, allowing for reduced gland water flow and lower gland water pressure. Similar improved performance can be obtained by implementing forwardly inclined vanes on an expeller, used in an expeller type pump sealing arrangement. In this case, when paired with an impeller with traditional radial or rearward sloping expelling vanes on the back shroud, the expeller with forwardly inclined vanes can be used to increase the sealing efficiency of the expeller seal by a margin of up to 20% or greater. In this case, the forwardly inclined vanes are reducing the pressure differential between the expeller chamber and the main pumping chamber. This increases the effective pressure range for which an expeller seal may be used for any particular pump size.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "top" and "bottom", "front" and "rear", "inner" and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The reference numerals in the following claims do not in any way limit the scope of the respective claims.

Table of Parts

| | |
|---|---|
| Pump apparatus | 100 |
| Pump | 10 |
| Pedestal | 112 |
| Outer casing | 22 |
| Side casing sections | 23, 24 |
| Inlet hole | 28 |
| Discharge outlet hole | 29 |
| Inner liner | 11 |
| Main liner | 12 |
| Side liners (front and back) | 14, 30 |
| Bolts | 27 |
| Pumping chamber | 42 |
| Seal chamber housing | 114 |
| Drive shaft | 116 |
| Stuffing box | 117 |
| Chamber | 118 |
| Impeller | 40 |
| Delivery section | 32 |
| Passage | 33 |
| Outer end | 34 |
| Inner end | 35 |
| Sidewall section | 15 |
| Inner face | 37 |
| Inner face | 16 |
| Lip | 38 |
| Hub | 41 |
| Pumping vanes | 43 |
| Eye portion | 47 |
| Impeller inlet | 48 |
| Front shroud | 50 |
| Back shroud | 51 |
| Outer peripheral edge portion | 57 |
| Inner face | 55 |
| Outer face | 54 |
| Inner face | 53 |
| Outer face | 52 |
| Auxiliary vanes | 60 |
| Auxiliary vanes | 61 |
| Inner side | 63 |
| Outer side | 65 |
| Leading side | 66 |
| Inner edge | 62 |
| Outer edge | 64 |
| Trailing side | 67 |
| Forwardly inclined section | 68 |
| Upper side | 69 |
| Main surface | 71 |
| Inclined surface | 73 |
| Intermediate region | 74 |
| Trailing section | 75 |
| Intermediate section | 76 |
| Drive shaft | 80 |
| Centrifugal seal assembly | 82 |
| Expeller | 83 |
| Main body | 84 |
| Surface | 81 |
| Surface | 93 |
| Inner section | 85 |
| Outer side | 86 |
| Outer peripheral edge portion | 91 |
| Seal chamber | 87 |
| Passageway | 88 |
| Expelling vanes | 89 |
| Main seal apparatus | 90 |
| Inner side | 163 |
| Outer side | 165 |
| Leading side | 166 |
| Inner edge | 162 |
| Outer edge | 164 |
| Trailing side | 167 |
| Upper side | 169 |
| Main surface | 171 |
| Inclined surface | 173 |

The invention claimed is:

1. An impeller for a pump which can be rotated in a forward direction about a rotation axis X-X; the impeller comprising:

two shrouds, one being a front shroud, the other being a back shroud, pumping vanes extending between the shrouds, the front and back shrouds each having an outer peripheral edge portion and opposed inner and outer faces, a plurality of expelling vanes extending along the outer face of at least one of the front shroud and back shroud, each expelling vane having an inner side and an outer side which is at or near the outer peripheral edge portion of the at least one of the front and back shroud, the expelling vanes extending in a direction between the rotation axis X-X towards the outer peripheral edge portion of the at least one of the front and back shroud, each expelling vane further having:

a leading side facing in the forward direction and having an inner edge that is the innermost edge of the expelling vane and an outer edge that is an outermost edge of the expelling vane, a trailing side facing in a rearward direction, and an upper side spaced from the outer face of the at least one of the front and back shroud, characterized in that the leading side includes a forwardly inclined section which is inclined forwardly from a radial line Y-Y extending from the rotation axis X-X and which passes through the inner edge of the leading side, the forwardly inclined section extending from the inner edge towards the shroud outer peripheral edge portion of the at least one of the front and back shroud, and the forwardly inclined section having a profile which is linear, wherein the forwardly inclined section extends from the inner edge and terminates at an intermediate region which is in spaced relation from the outer peripheral edge portion of at least one of the front and back shroud, the leading side further including a trailing section which extends rearwardly from the intermediate region of the forwardly inclined section.

2. The impeller according to claim 1, wherein the leading side includes an intermediate section which is curved and between the trailing section and the forwardly inclined section.

3. The impeller according to claim 2, wherein the trailing section of the leading side is curved.

4. The impeller according to claim 2, wherein the outer edge is at the trailing section and terminates at the outer peripheral edge portion of.

5. A rotary part for a pump which can be rotated in a forward direction about a rotation axis X-X, the rotary part comprising:

one or more shrouds having an outer peripheral edge portion and opposed first and second faces, a plurality of expelling vanes extending along one or more of the second faces of the one or more shrouds, each expelling vane having an inner side and an outer side which is at or near the outer peripheral edge portion of said shroud, the expelling vanes extending in a direction between the rotation axis X-X towards the outer peripheral edge portion of said shroud, each expelling vane further having:

a leading side facing in the forward direction and having an inner edge and an outer edge, a trailing side facing in a rearward direction, and an upper side spaced from the second face of said shroud, characterized in that the leading side includes a forwardly inclined section which is inclined forwardly from a radial line Y-Y extending from the rotation axis X-X and which passes through the inner edge of the leading side, the forwardly inclined section extending from the inner edge towards the shroud outer peripheral edge portion;

wherein the forwardly inclined section extends from the inner edge and terminates at an intermediate region which is in spaced relation from the outer peripheral edge portion of said shroud, the leading side further including a trailing section which extends rearwardly from the intermediate region of the forwardly inclined section, and wherein the rotary part is an impeller which comprises two shrouds, one being a front shroud, the other being a back shroud, and pumping vanes extending between the shrouds, each shroud having an inner face and an outer face, the expelling vanes being on the outer face of at least one of the front shroud and back shroud.

6. The rotary part according to claim 5, wherein the leading side includes an intermediate section which is curved and between the trailing section and the forwardly inclined section.

7. The rotary part according to claim 5, wherein the trailing section of the leading side is curved.

8. The rotary part according to claim 5, wherein the outer edge is at the trailing section and terminates at the outer peripheral edge portion of.

* * * * *